US008079242B2

(12) United States Patent
Pacaud et al.

(10) Patent No.: US 8,079,242 B2
(45) Date of Patent: Dec. 20, 2011

(54) CRIMPING SYSTEM WITH INTEGRATED MONITORING

(75) Inventors: Alain Pacaud, Aix en Provence (FR); Philippe Tontic, Marseilles (FR)

(73) Assignee: Eurocopter, Marignane Cedex (FR)

( * ) Notice: Subject to any disclaimer, the term of this patent is extended or adjusted under 35 U.S.C. 154(b) by 810 days.

(21) Appl. No.: 12/117,892

(22) Filed: May 9, 2008

(65) Prior Publication Data

US 2008/0276678 A1 Nov. 13, 2008

(30) Foreign Application Priority Data

May 11, 2007 (FR) ..... 07 03375

(51) Int. Cl.
*B21C 51/00* (2006.01)

(52) U.S. Cl. ..... 72/21.4; 72/21.1; 72/409.01; 72/409.1

(58) Field of Classification Search ..... 72/402, 72/409.1, 409.06, 409.07, 409.08, 409.18, 72/21.4, 409.01
See application file for complete search history.

(56) References Cited

U.S. PATENT DOCUMENTS 4,910,857 A * 3/1990 Tanaka ..... 72/409.08
5,038,461 A 8/1991 Cerda
5,197,186 A 3/1993 Strong et al.
5,490,406 A * 2/1996 College ..... 72/30.1
7,461,448 B2 * 12/2008 Schwartzman et al. ..... 72/402
2001/0011994 A1 8/2001 Morimoto et al.
2005/0050702 A1 * 3/2005 Green ..... 29/263

FOREIGN PATENT DOCUMENTS

DE 298 06 179 U1 10/1998
EP 0415 831 A1 3/1991
WO 97/25757 A 7/1997

* cited by examiner

*Primary Examiner* — Dana Ross
*Assistant Examiner* — Pradeep C Battula
(74) *Attorney, Agent, or Firm* — Brooks Kushman P.C.

(57) ABSTRACT

A crimping tool including a punch carrier, a plurality of punches movable in translation in radial housings of the punch carrier, a thrust member having an inside face co-operating with the outer ends of the punches, the thrust member being pivotally mounted relative to the punch carrier, such that pivoting of the thrust member causes a contact to be crimped, a tool body having two pivotal handles for causing the thrust member and the punch carrier to pivot mutually, and a member for adjusting the stroke of the punches, a sensor sensitive to the position of the member for adjusting the stroke of the punches, a sensor sensitive to an identity signal from a contact positioning tool, and a memory associated with the position sensor and with the identity sensor and arranged to record the data delivered by the sensors and/or to deliver the data to a data processor unit.

18 Claims, 2 Drawing Sheets

CRIMPING SYSTEM WITH INTEGRATED MONITORING

The present invention relates to a crimping system with integrated monitoring and to a crimping tool for such a system.

The technical field of the invention is that of fabricating crimping tools.

BACKGROUND OF THE INVENTION

The present invention relates in particular to a crimping system comprising a crimping clamp and a tool for positioning a contact—a pin or a connector—for crimping to the end of a conductor wire, the crimping clamp and the positioning tool being capable of being releasably (reversibly) secured to each other, as described in particular in patent GB-1 385 426.

The invention applies in particular to such a system in which the clamp is fitted with a force sensor that is sensitive to the crimping force, the system further including a data processor unit connected to the clamp to control it, to deliver thereto signals/data conveying information useful for a crimping operation that is to be performed, and/or for receiving data/signals therefrom conveying information relating to a crimping operation in progress (or that has already been performed).

Such systems are described in the following patents: EP-0 415 834, EP-0 873 582, and DE-U-29 806 179.

The invention relates in particular to systems in which the crimping tool—the clamp—has a plurality of crimping punches that are movable in translation in housings of a punch carrier, which housings extend radially relative to an axis along which the conductor and the pin for crimping are to extend, as described in patents EP-0 415 831 and EP-0 873 582.

In those tools, a thrust member comprising a ring having a profiled inside face—acting as a cam—co-operates with the outer ends of the punches and is mounted to pivot about said axis relative to the punch carrier. Pivoting of the thrust member relative to the punch carrier causes the punches to move centripetally and thus causes a contact that is "clamped" in this way between a plurality of pairs of punches to be crimped.

The invention applies in particular to a crimping clamp that does not include a motor and that comprises:

- a tool body comprising two handles/arms that are pivotable (manually) about said axis to cause mutual pivoting between the thrust member and the punch carrier; and
- a (manual) adjustment member, e.g. a thumb wheel or a slider, for adjusting the stroke of the punches, and consequently the depth of the crimping, for a determined—maximum—stroke of the handles of the clamp.

Known crimping systems do not make it possible to avoid the defects that might occur, and in particular: i) from using a clamp having a crimping mechanism that, as a result of wear, no longer complies with the required standard for crimping accuracy; ii) from using a positioner that does not correspond to the contact, to the conductor wire, to the clamp, to the set of punches in the clamp, and/or to the stroke of the punches; iii) from incorrectly adjusting the crimping parameters; iv) from poor quality contacts; v) from a cable of the wrong gauge; vi) from defective stripping; and/or vii) from poor positioning of the wire/cable.

Known crimping systems do not make it possible to detect all of the above defects, and some of them require destructive testing to be performed.

OBJECTS AND SUMMARY OF THE INVENTION

An object of the invention is to propose a simplified lightweight crimping tool, in particular for facilitating use thereof away from a cabling workshop, while also making it easier to ensure quality control over the crimping operation.

An object of the invention is to provide a crimping system that facilitates crimping close to or inside the fuselage of an aircraft, in particular for maintenance operations on board the aircraft.

An object of the invention is to propose such crimping systems and tools that are improved and/or that remedy, at least in part, the shortcomings or drawbacks of known crimping tools/systems.

According to an aspect of the invention, there is proposed a crimping tool—and a system incorporating the tool—that further comprises:

- a first position sensor sensitive to the position of the adjustment member for (manually) adjusting the stroke of the punches;
- a (contactless) identity sensor sensitive to an identity signal (or data) from a contact positioning tool (pin), when the positioning tool is placed in the proximity of and/or is (temporarily) secured to the crimping clamp; and
- a memory associated with (connected to) the first position sensor and the identity sensor, and arranged to store data delivered by said sensors and/or to deliver said data to a data processor unit (which may be incorporated at least in part in the clamp).

The invention makes it possible in particular to verify automatically the compatibility (matching) between the positioning tool in use, a positioner, which is adapted to crimping a contact and to a segment of wire of determined dimensions, and the depth of crimping that will result from the position of the adjustment member.

In preferred embodiments of the invention:

- the tool (the clamp) further comprises a second position/movement sensor sensitive to the position of at least one of the punches, together with a force sensor sensitive to the crimping force, these second position and force sensors being connected to a signal/data processor unit integrated in the clamp, and to a memory that is likewise integrated therein, so as to make it possible during each crimping cycle, i.e. for each crimped contact, to record several tens or hundreds of data pairs each comprising a measured position of the punches and a measured crimping force, e.g. about 100 to 500 measurement points taken at regular intervals;
- the tool/clamp includes a memory containing identity data of the clamp and/or data defining an expiry date for using the clamp, i.e. a date for inspecting it for wear and possibly recalibrating it; and
- the tool/clamp includes a data display device for delivering at least one indication about the quality of crimping, e.g. by using lights. If the display makes this possible, other information can also be made available to the user, i.e. the number of crimping operations performed, the date on which the tool is to be inspected, the diameter of the most recently-crimped wire and/or contact.

According to another aspect of the invention, there is provided a crimping system comprising said crimping tool, said positioning tool that may for example comply with the MIL C 22520 standard, and an external data processor unit—such as a computer—that is connected to the crimping tool via a wireless connection, in particular via a radio connection.

This enables the information measured by the sensors incorporated in the crimping tool and relating to a complete crimping cycle to be transmitted to the computer. In the event of the wireless connection failing, a cable connection can perform the same functions.

BRIEF DESCRIPTION OF THE DRAWINGS

Other aspects, characteristics, and advantages of the invention appear in the following description which refers to the accompanying drawings that show preferred embodiments of the invention without any limiting character.

MORE DETAILED DESCRIPTION

Figure 1:
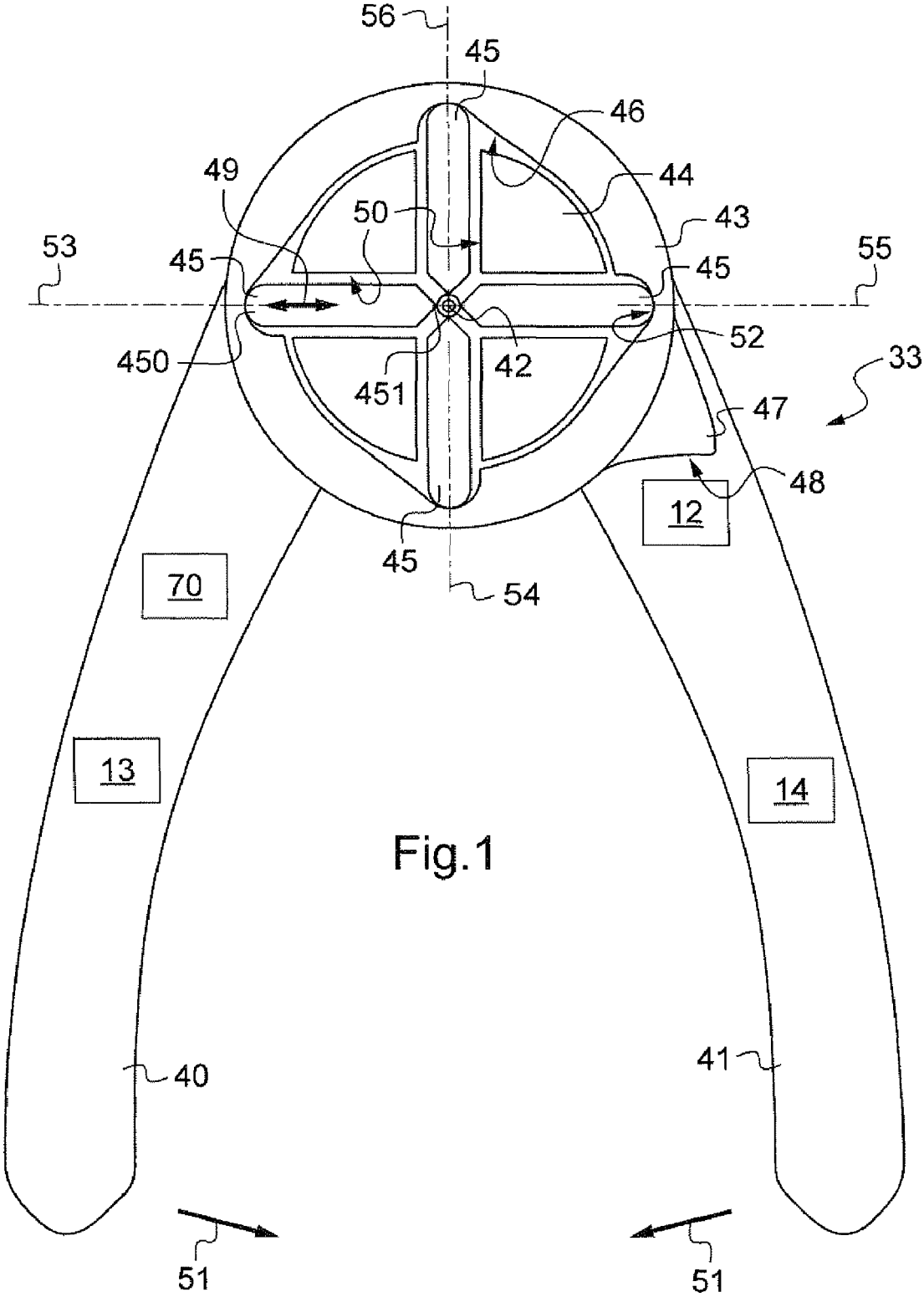
FIG. 1 is a diagram showing a crimping clamp of the invention.

With reference to FIG. 1, the crimping clamp 33 has two arms or handles 40 and 41 that are mounted to pivot relative to each other about a pivot axis 42 that is perpendicular to the plane of FIG. 1

The handle 41 is secured to a ring 43 about the axis 42, having an inside face 46 that is cylindrical in shape and that presents a profile that is periodic: the face is formed by four identical portions, each occupying 90° (about the axis 42), and each presenting a recessed portion 52.

The handle 40 is secured to a part 44 supporting four identical punches 45 received respectively in four housings or channels 50 provided in the part 44 and extending respectively along four coplanar axes 53 to 56 angularly spaced at 90° intervals.

Each punch has an inner end portion 451 that presents a shape (indentation) adapted to the pin for crimping, and an outer end portion 450 that is designed to slide against the inside face 46, 52 of the ring against which it bears.

The clamp is fitted with a second position sensor 13 that is sensitive to the relative angular position of the arms 40, 41 and/or to the position—and to the movement in translation—of at least one punch in its housing.

The clamp is also fitted with a force sensor 14 sensitive to the force exerted for moving the arms towards each other (along arrows 51), and/or sensitive to the force exerted by the ring 43 on the punch(es), and/or sensitive to the force exerted by the punch(es) on the pin (connector or contact) while it is being crimped onto an electrical conductor.

These second position and force sensors 13, 14 may be of the piezoelectric type or of the strain gauge type and they may be incorporated in the clamp in a manner that is identical or similar to that described in document DE-U-29 806 179.

The ring 43 presents an outer projection 47 having a portion or face 48 of position that can be detected and/or measured by a first position sensor 12 sensitive to the position of said face.

The ring 43 is connected to the arm 41 while being pivotal relative thereto about the axis 42 over a limited angular stroke, of the order of ten or several tens of degrees, so as to enable the stroke of the punches to be adjusted for a given stroke of the arms 40, 41 of the clamp.

The relative position of the ring can be adjusted by acting on a thumb wheel presenting a plurality of adjustment positions and a stop position that, when selected, switches off the electrical power supply to the components of the clamp. Each adjustment position causes the punches to be pushed in by a different amount, and consequently gives rise to a different crimping force.

In a variant not shown, the ring 43 may be rigidly connected to the arm 41, while the punch carrier 44 is capable of limited angular movement relative to the arm 40. Under such circumstances, the first position sensor 12 is sensitive to relative pivoting of the punch carrier relative to the arm 40.

The clamp may be fitted with a data display device 70 comprising at least indicator lights of colors that depend on the quality of the crimping operation performed.

Figure 2:
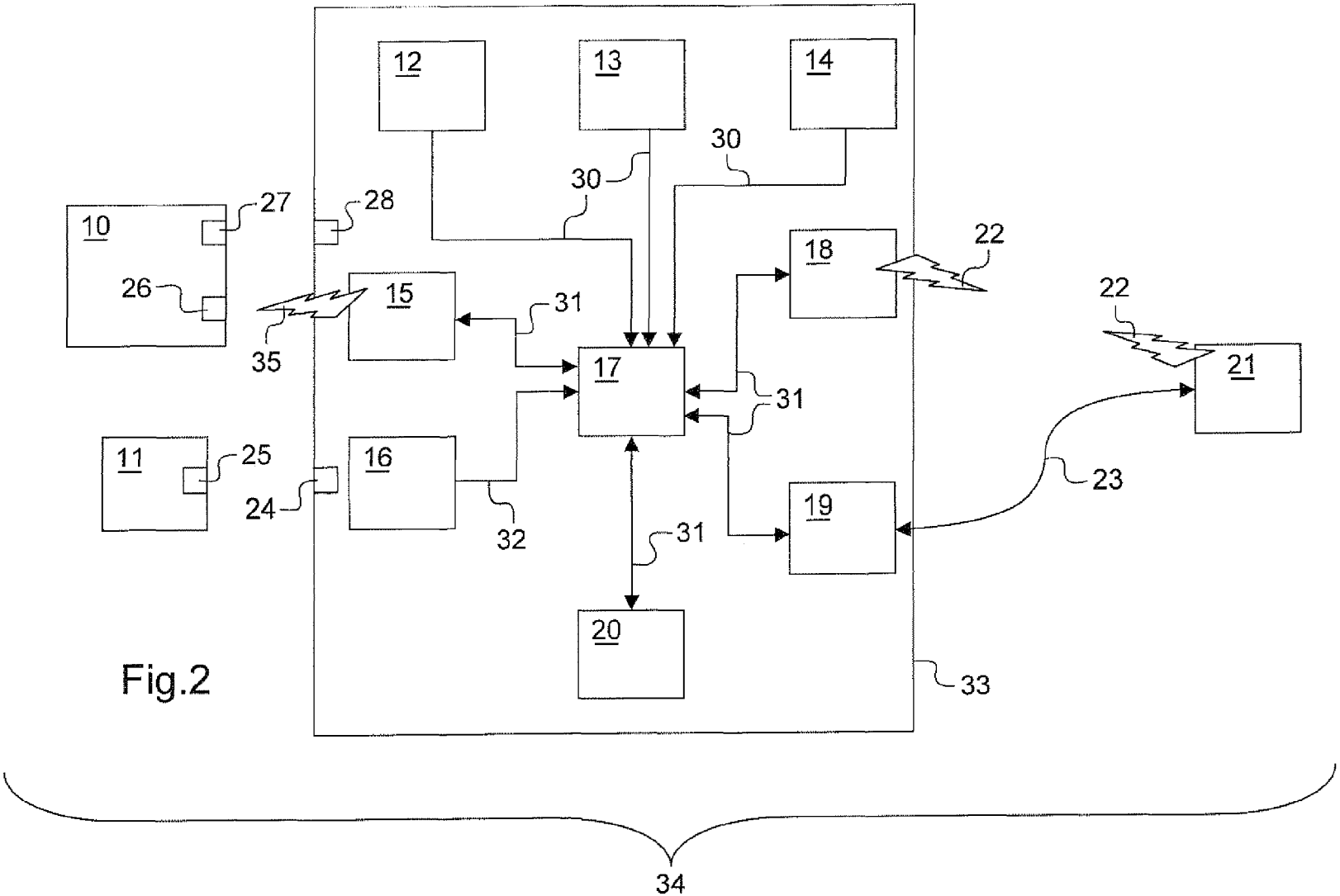
FIG. 2 is a diagram showing the main components of a crimping system of the invention and the connections between the components.

As shown in FIG. 2, the crimping system 34 comprises, in addition to the clamp 33, a positioner, i.e. a positioning tool, referenced 10, a battery charger 11, and an external data processor unit 21.

The positioning tool 10 presents a housing used for receiving at least a portion of a contact for crimping, and a mechanical connection member 27 that is arranged/shaped to cooperate with a complementary mechanical connection member 28 that is integrated in the clamp 33.

The members 27 and 28 are designed to provide a reversible mechanical connection between the positioner and the clamp, in order to hold the contact for crimping in a determined position relative to the crimping members of the clamp. The members 27 and 28 may for example be in the form of a screw connection or a bayonet connection.

The clamp includes said first position sensor 12 that is sensitive to the position of the adjustment member (referenced 47 in FIG. 1) for adjusting the amplitude of the stroke of the punches, said second position sensor 13 sensitive to the position of one or more of said punches in their housing(s), and said force sensor 14 that is sensitive to the crimping force.

The clamp includes an integrated data processor unit 17 for processing signals and/or data, such as a microprocessor, that is connected via connections 30 to the sensors in order to receive signals therefrom, to convert them into digital data, and to store them temporarily in a memory 20 also connected to the integrated data processor unit 17, via a connection 31.

A battery 16 incorporated in the clamp acts via a connection 32 to power the integrated data processor unit 17 and, where appropriate, the sensors 12-14 and/or interfaces 15, 18, 19 for transmitting signals/data. The battery charger 11 includes electrical and mechanical connector members that are complementary to members 24 of the same kind that are integrated in the clamp, so as to enable the battery 16 to be charged.

The interface 15 connected to the integrated data processor unit 17 via a both-way connection 31 is arranged to read remotely identification data of the positioner 10, which data is recorded on a data medium 26 integrated in the positioner. This reading (represented symbolically at 35) can be performed in various ways, e.g. by optically reading a bar code marked on a label secured to the positioning tool 10.

In a preferred embodiment, this reading is performed by radio waves, the positioning tool 10 being equipped with a radiofrequency identity (RFID) label.

The interfaces 18 and 19 are connected to the integrated data processor unit 17 via both-way connections 31 enabling each of them to exchange data (symbolically referenced at 22) between the data processor unit 17 integrated in the clamp and the external data processor unit 21, e.g. constituted by a laptop computer. The interface 18 provides a wireless connection between the integrated 17 and extended 21 data processor unit, while the interface 19 is provided for a wire connection 23 between these members.

In a variant embodiment, the integrated data processor unit 17 may perform the same processing and analysis functions on the various signals in order to establish whether crimping has been performed correctly as are performed by the remote computer 21; under such circumstances, the second computer could even be omitted, but it can also serve to store and manage (create, update, make use of, . . . ) the collection of reference curves used for validating the crimping operations.

The clamp may be fitted with a manual device (e.g. the stroke-adjustment thumb wheel) enabling it to be switched on and off and enabling the processing of the data processor unit of the clamp to be reinitialized.

The clamp may be arranged to store the measured information relating to a plurality of crimping cycles, in particular several hundred of the most recent crimping operations, in a memory card integrated in the clamp. The card may be designed to conserve data without being electrically powered, so as to be suitable for being removed from the clamp and read by means of the computer.

The clamp may be fitted with an automatic device enabling its battery endurance to be monitored. Before the battery becomes too low for ensuring that all of the functions of a plurality of crimping operations can be performed (which predetermined number may be recorded in a settings file), a warning light can be switched on.

At least one of the data processor units 17 and 21 may be programmed to perform the following operations:

determining, from the measurements delivered by the second position sensor 13, the absolute movement of at least one punch;

determining, from the measurements delivered by the force sensor 14, the forces applied to or by at least one punch; and determining, from the measured (absolute) movements of the punches, the diameter of the crimped contact and/or cable by analyzing the results of the force and movement measurements.

The computer 21 may be programmed to record this information in a file that includes the ID number of the clamp, the ID number of the positioner, the setting of the adjustment thumb wheel, the diameter of the contact for crimping, the crimping operation number (incremented automatically on each crimping operation), the current time (hours, minutes, seconds), and the measurements picked up by all of the sensors of the clamp at each point of the crimping cycle (electrical value and corresponding physical value).

In the event of a failure to transmit measured data over the wireless connection 25, the clamp may be programmed to transmit again, with the number of failed attempts at transmission being limited to a value that is contained in the settings file. If this number is exceeded, a light incorporated in the clamp can be switched on to signal this failure.

In the event of possible malfunction of the clamp (faulty sensors, loss of functions, . . . ), another light can be switched on.

The components of the clamp can be powered by batteries, optionally rechargeable batteries. A mechanical anti-return system can prevent an ongoing crimping operation from being interrupted until it has been completed.

The computer 21 may be programmed to enable an operator to perform the following actions:

read, view, edit, and record a file containing the data transmitted by the clamp;

input a name, a reference, and a batch number of the cable and of the contact for crimping;

view crimping curves (force/displacement curves and slope/displacement curves for all the sensors); these curves may be superposed on envelope curves which, by comparison make it possible to decide whether or not crimping has been performed properly; it is possible to envisage other forms of curve analysis);

record all of the crimping operations performed;

use the computer to monitor the state of the wireless connection, to interrogate the sensors, and to switch on the lights incorporated in the clamp, in the display module 70;

indicate the number of crimping operations performed; and optionally diagnose crimping; such diagnosis is based on the settings that have been input and that are given in the received data file by comparing the current crimping operation with databases that have been established by using reference curves and envelopes (forces, slopes, areas).

The computer may also be programmed to determine automatically the reference of the contact and/or of the cable.

In order to determine the reference of the contact, the system determines and displays the references of the contact (s) that appear in a database and that correspond to the characteristics of the crimped contact (outside diameter, positioner used, position of the thumb wheel). The reference can be refined, should that be necessary, so as to have only one contact reference, by comparing curves for the crimping operation performed with force curves, slopes, and areas in the database.

The computer 21 may also be programmed to determine the gauge of the cable used, from the crimping curve obtained, and from the reference curve in the "contacts only curves" database relating to the contact that has just been crimped (as previously determined).

With the contact and the crimping force curve defined, the program "recovers" the "contact only curve" and takes the difference between the two curves ("crimping obtained" and "contact only"). The resulting curve can be compared with the "cables only curves" database. The result of this comparison gives the gauge of the cable.

These determinations can be performed by using the areas that correspond to different portions of the crimping curves, the amplitudes of the force curves, and/or the slopes of these curves.

The gauge value(s) as obtained in this way can be compared with a value determined from the position of the thumb wheel and from the type of positioner that has been detected/identified.

The program also enables the clamp to be calibrated: for each position of the member for adjusting the stroke of the clamp, it is possible to record the maximum and minimum clamping diameter values measured with the help of test pieces.

These processing operations may rely on a plurality of databases, for example:

a "contact+cable curves" database that, for each known contact reference associated with a given cable gauge contains the corresponding crimping curve, together with envelope curves;

a "contact only curves" database that, for each known contact reference, contains the crimping curve of said contact without a cable, and also envelope curves;

a "cable only curves" database that, for each known cable gauge, contains the crimping curves for the cable without the contact, together with envelope curves. In practice, these curves are determined by taking the difference between a "cable–contact" crimping curve and a "contact only" crimping curve;

a "contact characteristics" database that contains the references of contacts, their dimensional characteristics, and the respective positioners to be used therewith, and the thumb wheel settings in association with each gauge of cable to be crimped on the contact;

a "cables+contact crimping areas" database that contains the value of the crimping area of the curves in the "contact+cable curves" database, together with the areas of the envelope curves;

a "contact only crimping areas" database that contains the values of the crimping areas of the curves in the "contact only curves" database, together with the areas of the envelope curves;

a "cable only areas" database that contains the values of the crimping areas of the curves in the "cable only curve" database, together with the areas of the envelope curves (obtained by taking the following difference: "cables+contact crimping areas"–"contact only crimping areas");

a "cable+contact slopes" database that, for each given known contact reference associated with a cable gauge contains the corresponding crimping slopes together with the envelope curves of the slopes;

a "contact only slopes" database that, for each known contact reference contains the crimping slopes of the contact without a cable, and also the slope envelope curves; and a "cable only slopes" database that, for each known cable reference, contains the crimping slopes of the cable without contact, together with the envelope curves of the slope. In practice, these slopes are determined by taking the difference between a "cable+contact crimping slope" and a "contact only crimping slope".

The result of a crimping operation being analyzed by the external computer 21 can be transmitted to the clamp via the wireless connection.

If the curve giving variation in crimping force as a function of the movement of the punch(es) lies within the limits set by the envelope curve, meaning that crimping has been done properly, a "0" value can be transmitted to the clamp and a "green" light integrated in the clamp within the display device 70 can be switched on to inform the operator that the most recently performed crimping operation was performed properly.

Otherwise, a "1" value can be transmitted to the clamp and a "red" light integrated in the clamp can be switched on to inform the operator that the most recently performed crimping operation is faulty.

What is claimed is:

1. A crimping tool comprising:

a punch carrier;

a plurality of punches movable in translation in housings in the punch carrier, which housings extend radially relative to an axis along which a conductor and a contact for crimping together are to extend;

a thrust member comprising a ring with a periodic profiled inside face acting as a cam that co-operates with an outer end of each of the punches, the thrust member being mounted to turn relative to the punch carrier about said axis, such that turning the thrust member relative to the punch carrier causes the plurality of punches to move centripetally and crimp the contact between the plurality of punches;

a tool body having two handles pivotally mounted about said axis to cause the thrust member to pivot relative to the punch carrier when the handles are manually actuated by an operator and not a motor;

an adjustment member for adjusting a stroke of the plurality of punches for a stroke of the handles of the crimping tool, the adjustment member including an outer projection connected to and extending from the ring;

a first position sensor for detecting a position of the outer projection for adjusting the stroke of the punches;

a contact positioning tool for receiving at least a portion of the contact;

an identity sensor for receiving an identity signal from the contact positioning tool when the contact positioning tool is placed in the proximity of and/or is secured to the crimping tool;

a data processor unit in communication with the first position sensor and the identity sensor, and arranged to store the data delivered by said first position sensor and the identity sensor, in order have quality control of a crimping operation;

an interface connected to the data processor unit via a both-way connection and arranged to read remotely identity data of the contact positioning tool that is recorded on a data medium integrated in the contact positioning tool; and two interfaces that are connected to the integrated data processor unit by both-way connections, each enabling data to be exchanged between the integrated data processor unit integrated in the clamp and an external data processor unit, a first one of the two interfaces providing a wireless connection between the integrated and the external data processor unit while the other one of the two interfaces is provided for a wire connection between the integrated and the external data processor unit.

2. A crimping tool according to claim 1, in which the identity sensor is a contactless sensor.

3. A crimping tool according to claim 1, in which the identity sensor is a radiofrequency identity label.

4. A crimping tool according to claim 1, in which the data processor unit is at least in part incorporated in the crimping tool.

5. A crimping tool according to claim 1, further including a second position sensor sensitive to the position of at least one of the punches, and a force sensor sensitive to the crimping force, the second position sensor and force sensor being connected to the data processor unit integrated in the crimping tool and to a memory that is also integrated therein, so as to make it possible for the processor to record a plurality of data pairs, each data pair comprising a punch position measurement and a crimping force measurement.

6. A crimping tool according to claim 1, including a memory containing a plurality of identity data of the crimping tool.

7. A crimping tool according to claim 1, including a memory containing data determining an expiry date for use of the crimping tool.

8. A crimping tool according to claim 1, in which the data processor unit is programmed:

to determine, from measurements delivered by a second position sensor, the absolute movement of at least one punch;

to determine, from measurements delivered by a force sensor, the forces applied to or by at least one punch; and to determine, the diameter of the crimped contact and/or the conductor by analyzing the results of the force measurement and the movement measurement.

9. A crimping tool according to claim 1, and further comprising an external contact positioning tool and an external data processor unit connected to the crimping tool via respective wireless connections, in particular via a radio connection.

10. A crimping tool according to claim 9, in which the external data processor unit is programmed to analyze crimping data transmitted by the crimping tool and to transmit the result of the analysis to the crimping tool.

11. A crimping tool for crimping a conductor and a contact together, the crimping tool comprising:

a punch carrier;

a plurality of punches moveably housed in the punch carrier, the plurality of punches extending radially relative to an axis along which the conductor and the contact for crimping together extend along;

a thrust member comprising a ring with a profiled inside face acting as a cam that co-operates with an outer end of each of the punches, the thrust member being mounted to turn relative to the punch carrier about the axis, such that turning the thrust member relative to the punch carrier causes the punches to move centripetally and the crimp the contact to the conductor between the plurality of punches;

a pair of handles spaced apart a distance in order to be gripped by an operator, the pair of handles pivotally mounted about the axis and connect to the thrust member in order to pivot the thrust member relative to the punch carrier when the handles are manually actuated by an operator and not a motor;

an adjustment member for adjusting the stroke of the punches for a stroke of the handles of the crimping tool;

a position sensor receiving a punch position measurement of the position of at least one of the punches;

a force sensor receiving a crimping force measurement of a force applied by the punches to the contact;

a data processor unit in communication with the position sensor and the force sensor, and arranged to record a plurality of data pairs, each data pair comprising a punch position measurement and a crimping force measurement, in order to determine the diameter of the contact and/or conductor;

an interface connected to the data processor unit via a both-way connection and arranged to read remotely identity data of the contact positioning tool that is recorded on a data medium integrated in the contact positioning tool; and two interfaces that are connected to the integrated data processor unit by both-way connections, each enabling data to be exchanged between the integrated data processor unit integrated in the clamp and an external data processor unit, a first one of the two interfaces providing a wireless connection between the integrated and the external data processor unit while the other one of the two interfaces is provided for a wire connection between the integrated and the external data processor unit.

12. The tool according to claim 11, wherein the position sensor is located in at least one of the pair of handles.

13. A crimping tool according to claim 11 and further comprising an external contact positioning tool for receiving at least a portion of the contact for crimping, and an identity sensor receiving an identity signal of the diameter of a contact for crimping from the contact positioning tool when the contact positioning tool is placed in the proximity of the crimping tool.

14. The tool according to claim 13, in which the identity sensor is a contactless sensor.

15. The tool according to claim 13, in which the identity sensor is a radio frequency identity label.

16. The tool according to claim 13 wherein the contact positioning tool is mechanically coupled to the crimping tool.

17. The tool according to claim 11, including a memory containing data for determining an expiry date for use of the crimping tool.

18. A crimping tool comprising:

a punch carrier;

a plurality of punches movable in translation in housings in the punch carrier, which housings extend radially relative to an axis along which a conductor and a contact for crimping together are to extend;

a thrust member comprising a ring with a profiled inside face acting as a cam that co-operates with an outer end of each of the punches, the thrust member being mounted to turn relative to the punch carrier about.said axis, such that turning the thrust member relative to the punch carrier causes the plurality of punches to move centripetally and crimp the contact between the plurality of punches;

a tool body having two handles pivotally mounted about said axis to cause the thrust member to pivot relative to the punch carrier when the handles are manually actuated by an operator and not a motor;

an adjustment member for adjusting a stroke of the plurality of punches for a stroke of the handles of the crimping tool, the adjustment member including an outer projection connected to and extending from the ring;

a first position sensor for detecting a position of the adjustment member for adjusting the stroke of the punches;

a contact positioning tool for receiving at least a portion of the contact;

an identity sensor for receiving an identity signal from the contact positioning tool when the contact positioning tool is placed in the proximity of and/or is secured to the crimping tool;

a data processor unit in communication with the first position sensor and the identity sensor, and arranged to store the data delivered by said first position sensor and the identity sensor, in order have quality control of a crimping operation;

an interface connected to the data processor unit via a both-way connection and arranged to read remotely identity data of the contact positioning tool that is recorded on a data medium integrated in the contact positioning tool; and two interfaces that are connected to the integrated data processor unit by both-way connections, each enabling data to be exchanged between the integrated data processor unit integrated in the clamp and an external data processor unit, a first one of the two interfaces providing a wireless connection between the integrated and the external data processor unit while the other one of the two interfaces is provided for a wire connection between said the integrated and the external data processor unit.

* * * * *